US008582996B2

(12) United States Patent
Takeuchi et al.

(10) Patent No.: US 8,582,996 B2
(45) Date of Patent: Nov. 12, 2013

(54) IMAGE FORMING APPARATUS HAVING A MOTOR TO DRIVE A DEVELOPER RETAINING UNIT AND A FIXING UNIT

(75) Inventors: Kenji Takeuchi, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 257 days.

(21) Appl. No.: 13/051,061

(22) Filed: Mar. 18, 2011

(65) Prior Publication Data

US 2011/0262165 A1 Oct. 27, 2011

(30) Foreign Application Priority Data

Apr. 27, 2010 (JP) ..... 2010-102430

(51) Int. Cl.
*G03G 15/20* (2006.01)

(52) U.S. Cl.
USPC ..... 399/67; 399/320

(58) Field of Classification Search
USPC ..... 399/67, 320, 222
See application file for complete search history.

(56) References Cited

U.S. PATENT DOCUMENTS

| | | | | |
|---|---|---|---|---|
| 4,806,968 | A * | 2/1989 | Watanabe et al. | 399/92 |
| 4,967,239 | A * | 10/1990 | Sakakura | 399/75 |
| 6,438,334 | B1 | 8/2002 | Honma | |
| 2006/0188291 | A1 | 8/2006 | Kawakami et al. | |
| 2008/0118274 | A1 * | 5/2008 | Ahn et al. | 399/167 |

FOREIGN PATENT DOCUMENTS

| | | | |
|---|---|---|---|
| JP | 2001-013815 | A | 1/2001 |
| JP | 2003-131464 | A | 5/2003 |
| JP | 2006-227368 | A | 8/2006 |
| JP | 2010091802 | A * | 4/2010 |

* cited by examiner

*Primary Examiner* — G. M. Hyder
(74) *Attorney, Agent, or Firm* — Banner & Witcoff, Ltd.

(57) ABSTRACT

An image forming apparatus includes: a developer retaining unit configured to carry a developer; a fixing unit including a rotatable heating member configured to heat a recording sheet to thermally fix the developer on the recording sheet; a motor configured to drive the developer retaining unit and the fixing unit; a transmission unit configured to transmit a driving force of the motor to the fixing unit; a switching mechanism configured to selectively transmit the driving force of the motor to the developer retaining unit, and shut off the driving force of the motor to the developer retaining unit; and a control unit configured to, in a cooling operation, control the switching mechanism to shut off the driving force of the motor to the developer retaining unit and control the motor to rotate the heating member while the heating member does not heat.

16 Claims, 7 Drawing Sheets

| | FIRST TIME PERIOD STAND-BY | CUT-OFF | RE-DRIVE |
|---|---|---|---|
| CONTINUOUS PRINTING | ○ | ○ | ○ |
| AFTER PRINTING | — | ○ | ○ |

FIG. 8

| | FIRST TIME PERIOD STAND-BY | CUT-OFF | RE-DRIVE |
|---|---|---|---|
| CONTINUOUS PRINTING | ○ | ○ | ○ |
| AFTER PRINTING | — | ○ | ○ |
| AFTER MODE SWITCH-OVER | — | ○ | ○ |

IMAGE FORMING APPARATUS HAVING A MOTOR TO DRIVE A DEVELOPER RETAINING UNIT AND A FIXING UNIT

CROSS REFERENCE OF APPLICATION

This application is based upon and claims the benefit of priority of Japanese Patent Application No. 2010-102430 filed on Apr. 27, 2010, the contents of which are incorporated herein by reference in its entirety.

BACKGROUND OF THE INVENTION

The disclosure relates to an image forming apparatus that includes a fixing unit having a heating member which heats a recording sheet and can be rotated so as to thermally fix a developer on the recording sheet.

As an image forming apparatus, a device is known which drives a fixing unit, a developing device and the like by the same driving source. As such an image forming apparatus, for example, one that drives the fixing unit for a predetermined time after the fixing processing, for the cooling of the fixing unit, is known.

SUMMARY

However, according to a configuration of the above-mentioned related art, there is a need to simultaneously drive the developing device or the like every time the fixing unit is driven after the fixing processing of the fixing unit, whereby there is a problem in that the life of the developing device or the like is shortened.

Thus, an object of the aspect of the disclosure is to provide an image forming apparatus that can use a developing device or the like (a developer retaining unit) over a long period of time.

The aspect of the disclosure provides an image forming apparatus comprising:

a developer retaining unit configured to carry a developer;

a fixing unit including a rotatable heating member configured to heat a recording sheet to thermally fix the developer on the recording sheet;

a motor configured to drive the developer retaining unit and the fixing unit;

a transmission unit configured to transmit a driving force of the motor to the fixing unit;

a switching mechanism configured to selectively transmit the driving force of the motor to the developer retaining unit, and shut off the driving force of the motor to the developer retaining unit; and a control unit configured to, in a cooling operation, control the switching mechanism to shut off the driving force of the motor to the developer retaining unit and control the motor to rotate the heating member while the heating member does not heat.

BRIEF DESCRIPTION OF THE DRAWINGS

FIG. 8 is a table that shows a modified example of a relationship between the timing when a cleaning mode is put and the timing when a cut-off control is put.

DESCRIPTION OF EXEMPLARY EMBODIMENTS

Next, a color printer of an example of an image forming apparatus according to an embodiment of the invention will be explained in detail with reference to suitable drawings. In the following description, a direction will be explained as a direction on the basis of a user at the time of using a color printer. That is, in FIG. 1, the left side facing a paper surface is "a front side", the right side facing the paper surface is "a rear side", the far side facing the paper surface is "a left side", and the front facing the paper surface is "a right side". Furthermore, an up and down direction toward the paper surface is "an up and down direction".

<The Whole Configuration of Color Printer>

Figure 1:
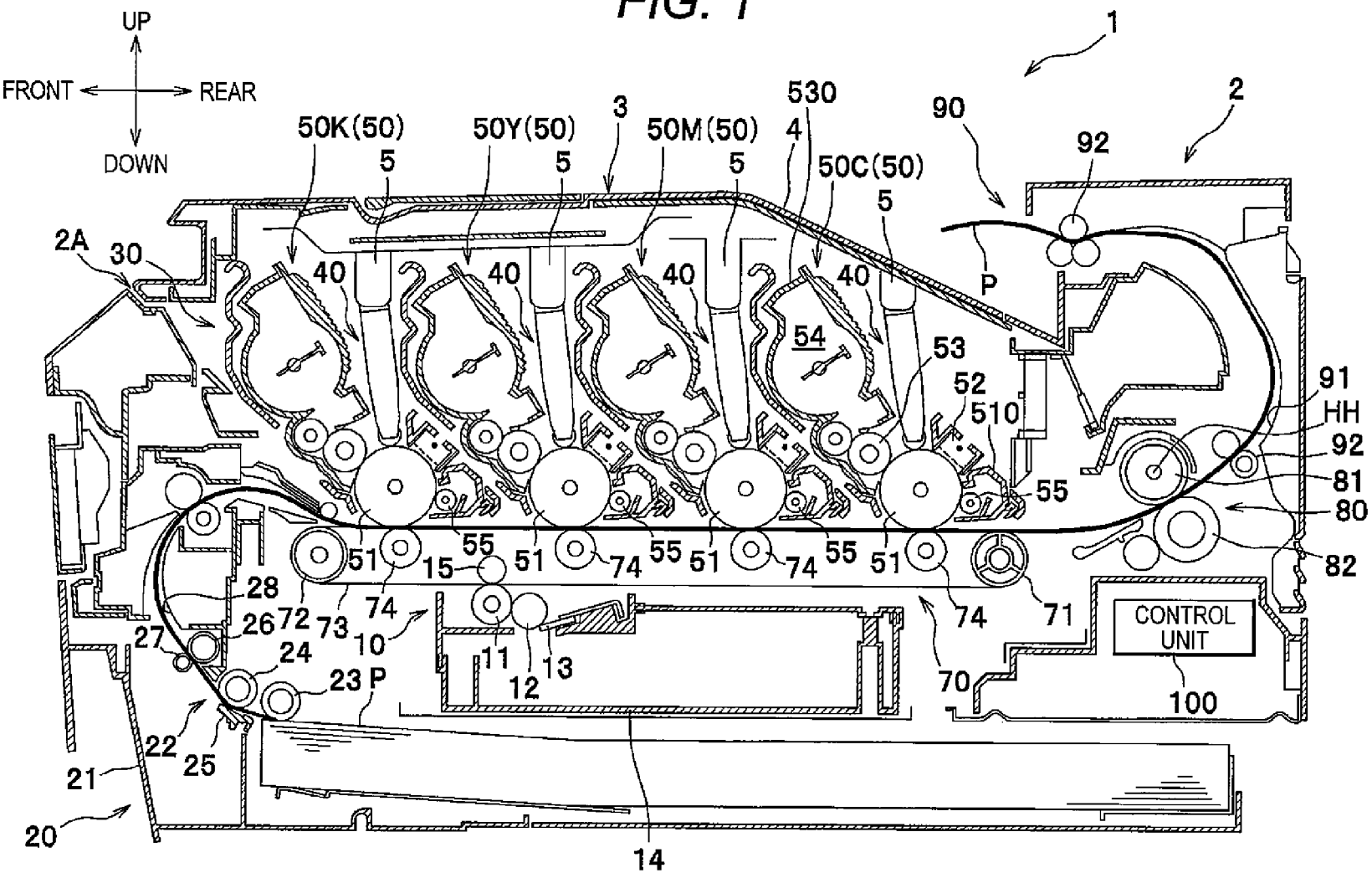
FIG. 1 is a side cross-sectional view that shows a color printer according to an embodiment of the invention.

As shown in FIG. 1, a color printer 1 includes a paper feeding portion 20 that feeds a paper P as an example of a recording sheet, an image forming portion 30 that forms an image on a supplied paper P, a discharge portion 90 that discharges the paper P with an image formed thereon, and a control unit 100, within a device main body 2.

An opening portion 2A is formed on an upper part of the device main body 2. Moreover, the opening portion 2A is adapted to be opened and closed by an upper cover 3 that is rotatably supported on the device main body 2. An upper surface of the upper cover 3 is formed of a paper discharging tray 4 which accumulates a paper P discharged from the device main body 2, and on a lower surface thereof, a plurality of LED attachment members 5 maintaining a LED unit 40 is provided.

The paper feeding portion 20 mainly includes a paper feeding tray 21 which is provided on the lower part of the device main body 2 and is mounted on the device main body 2 in an attachable and detachable manner, and a paper supplying mechanism 22 which transports the paper P from the paper feeding tray 21 to image forming portion 30. The paper supplying mechanism 22 is provided in the front side of the paper feeding tray 21, and mainly includes a paper feeding roller 23, a separating roller 24 and a separating pad 25.

In the paper feeding portion 20 configured in this manner, the papers P within the paper feeding tray 21 are separated one by one and transported to the upper part, and paper powders are removed in the process of passing between a paper power acquisition roller 26 and a pinch roller 27, and then, the direction of the paper P is changed to a backward direction through the transport path 28 and the paper P is supplied to the image forming portion 30.

The image forming apparatus 30 is mainly constituted by four LED units 40, four process cartridges 50, a transfer unit 70, a belt cleaner 10, and a fixing unit 80.

The LED units 40 are connected to the LED attachment member 5 in a rollable manner, and are suitably positioned and supported by a positioning member that is provided on the device main body 2.

The process cartridge 50 is arranged in a line in a front to rear direction between the upper cover 3 and the feeding paper portion 20, and includes a photoreceptor drum 51, a charger 52, a developing roller 53 as an example of a developer retainer, a toner accommodating chamber 54 that accommodates a toner as an example of the developer, a cleaning roller 55 or the like.

The process cartridges 50 are arranged so that those shown by reference numerals 50K, 50Y, 50M and 50C, in which the toners of the respective colors for black, yellow, magenta, and cyan are put, are arranged from an upstream of a transport direction of the paper P in this sequence. In addition, in the present description and the drawings, when specifying the photoreceptor drum 51, the developing roller 53, the cleaning roller 55 or the like corresponding to the colors of the toners, the reference numerals of K, Y, M and C are denoted so as to correspond to each of black, yellow, magenta, and cyan.

The photoreceptor drums 51 are provided in each of a plurality of process cartridges 50, and the plurality of process cartridges 50 is disposed as mentioned above, whereby the photoreceptor drums 51 are arranged along the front to rear direction in a row.

The developing roller 53 is a roller carrying a toner and comes into contact with the photoreceptor drum 51 to supply an electrostatic latent image on the photoreceptor drum 51 with the toners.

Figure 2:
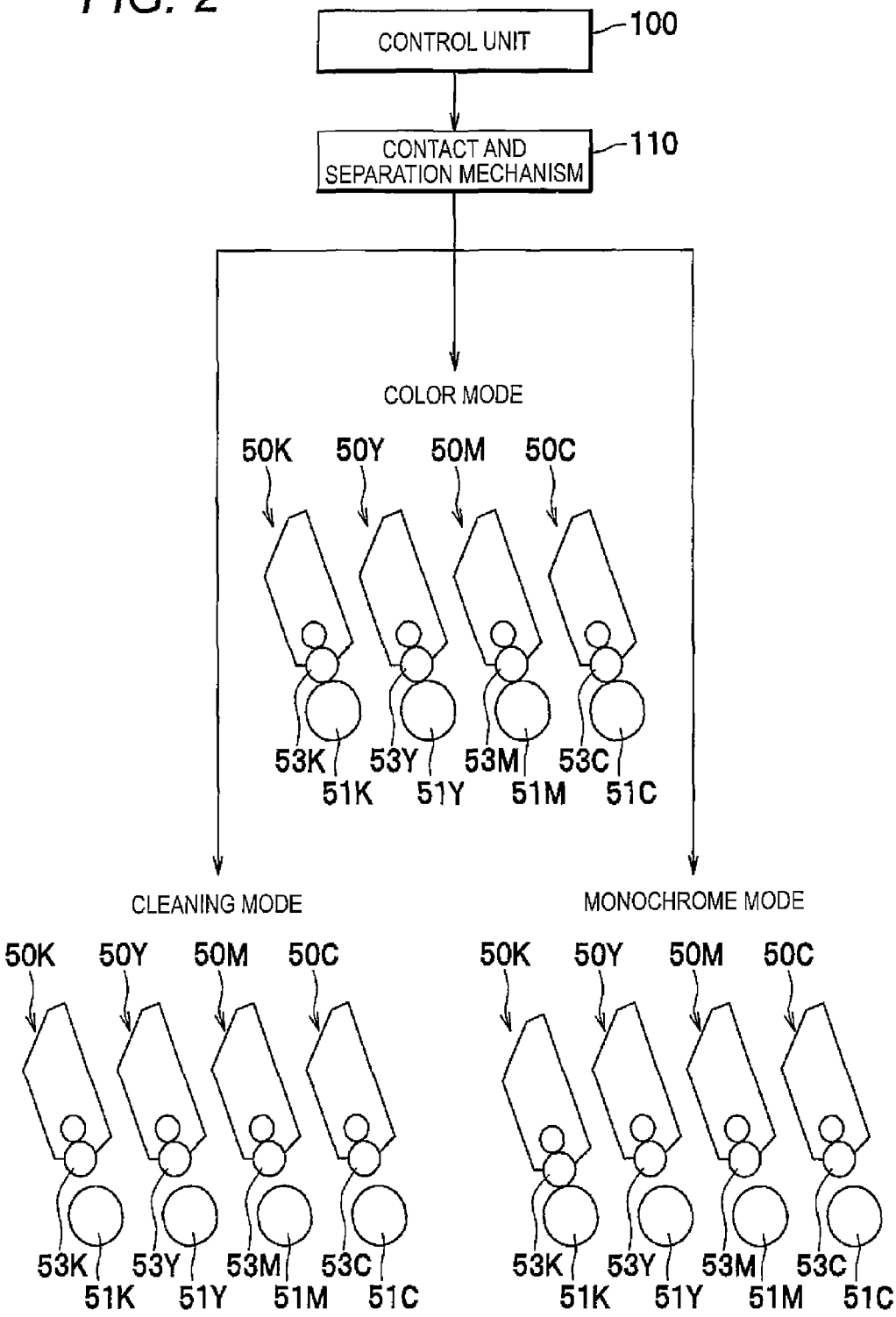
FIG. 2 is a diagram that describes the separation of a photoreceptor drum and a developing roller.

Moreover, as shown in FIG. 2, the developing roller 53 can be separated from the photoreceptor drum 51 by controlling a known contacting and separating mechanism 110 by the control unit 100. Specifically, as shown in FIG. 1, a developing unit 530 as an example of the developer retaining unit supporting the developing roller 53 is movably supported, with respect to a drum unit 510 that supports the photoreceptor drum 51, and the movement of the developing unit 530 is controlled by the contacting and separating mechanism 110, whereby the developing roller 53 can come into contact with the photoreceptor drum 51 and can be separated therefrom.

A plurality of cleaning rollers 55 is provided adjacent to the respective photoreceptor drums 51 so as to correspond to the respective photoreceptor drums 51. A cleaning bias is applied to the cleaning roller 55. Moreover, the cleaning bias is suitably controlled, whereby it is possible to maintain (withdraw) the toner to be attached on the photoreceptor drum 51 by the cleaning roller 55 or transfer the toner onto the photoreceptor drum 51.

The transfer unit 70 is provided between the paper feeding portion 20 and the respective process cartridges 50, and includes a driving roller 71, a driven roller 72, a transport belt 73, and a transfer roller 74.

The driving roller 71 and the driven roller 72 are disposed in parallel so as to be separated in the front to rear direction, and a transport belt 73 formed of an endless-shaped belt is installed therebetween. The transport belt 73 is adapted to be rotated by the driving roller 71 so that an outer peripheral surface thereof is moved along the arrangement directions of the respective photoreceptor drums 51. Furthermore, at the inside of the transport belt 73, four transfer rollers 74, which pinch the transport belt 73 between them and the respective photoreceptor drums 51, are disposed so as to face the respective photoreceptor drums 51. The transfer bias is applied to the transfer rollers 74 by a constant current control at the time of the transfer.

The belt cleaner 10 is a device which comes into sliding-contact with the transport belt 73, thereby withdrawing the toner or the like attached on the transport belt 73, and is disposed in the lower part of the transport belt 73. Specifically, the belt cleaner 10 includes a slide-contact roller 11, a withdrawal roller 12, a blade 13, and a waste toner receptor 14.

The slide-contact roller 11 is disposed so as to come into contact with the outer peripheral surface of the transport belt 73, and withdraws the attached matters on the transport belt 73 by applying the withdrawal bias between the slide-contact roller 11 and the back-up roller 15 disposed on the inner peripheral surface of the transport belt 73.

The withdrawal roller 12 is a roller which comes into slide-contact with the slide-contact roller 11, and withdraws the attached matters attached on the slide-contact roller 11. Moreover, the attached matters on the withdrawal roller 12 are removed by the blade 13 disposed so as to come into slide-contact with the withdrawal roller 12, and enter the waste toner receptor 14.

The fixing unit 80 includes a heating roller 81 as an example of a heating member, which is disposed in the rear side of the respective process cartridges 50 and the transfer unit 70, and a pressing roller 82 which is disposed oppositely to the heating roller 81 and presses the heating roller 81. The heating roller 81 is rotatably supported by a housing of the fixing unit 80 which is formed in a hollow cylindrical shape, and is heated by a halogen heater HH disposed in the inner portion thereof.

In the image forming apparatus 30 configured in this manner, in the case of the color mode, firstly, after the surfaces of the respective photoreceptor drums 51 are similarly positively charged by the charger 52, the surfaces are exposed by the respective LED units 40. As a result, the electric potential of the exposed portion declines, and the electrostatic latent image based on the image data is formed on the respective photoreceptor drums 51. Thereafter, the toner is supplied to the electrostatic latent image by the developing roller 53, whereby the toner image is carried on the photoreceptor drum 51.

The paper P supplied onto the transport belt 73 passes between the respective photoreceptor drums 51 and the respective transfer rollers 74 to be disposed inside the transport belt 73, whereby the toner images formed on the respective photoreceptor drums 51 are transferred onto the paper P. Moreover, the paper P passes between the heating roller 81 and the pressing roller 82, whereby the toner images transferred onto the paper P are thermally fixed.

The paper discharging portion 90 mainly includes a paper discharging side transport path 91, which extends from an exit of the fixing unit 80 toward an upper part thereof and is formed so as to be reversed frontward, and a plurality of pairs of transport rollers 92 which transports the paper P. The paper P, onto which the toner image is transferred and thermally fixed, is transported along the paper discharging side transport path 91 by the transport roller 92, discharged to the outside of the device main body 2, and accumulated on the paper discharging tray 4.

<Driving Force Transmission Mechanism>

Next, a structure for giving the above-mentioned respective components a driving force will be described.

Figure 3:
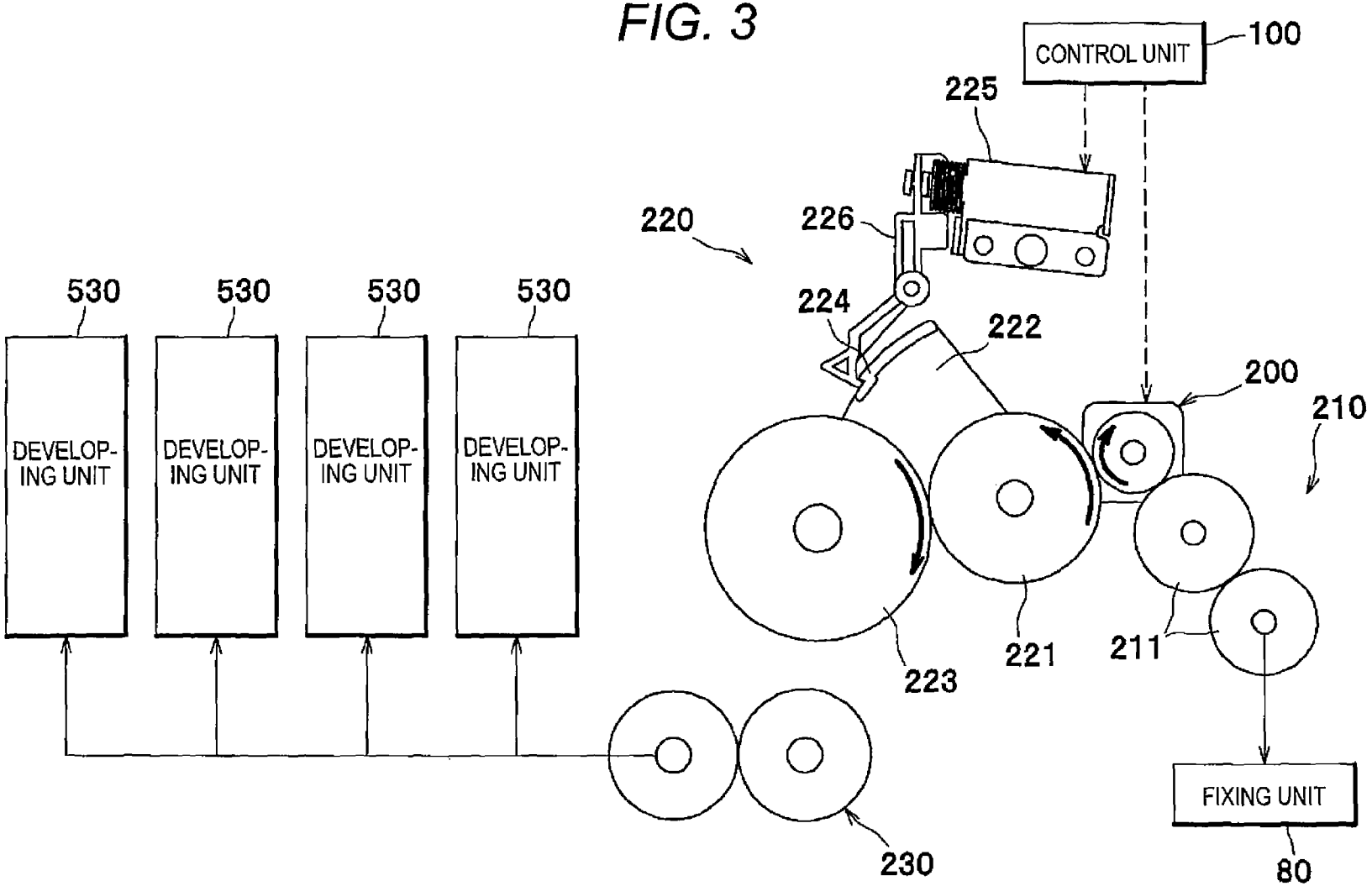
FIG. 3 is an explanatory diagram that shows the state when a transmission switch-over mechanism is cut.

As shown in FIG. 3, a plurality of developing units 530 and the fixing unit 80 are configured to be driven by one motor 200. Specifically, between the motor 200 and the fixing unit 80, a transmission unit 210 including a plurality of gears 211 for transmitting the driving force from the motor 200 to the fixing unit 80 is provided.

Furthermore, between the motor 200 and the respective developing units 530, a transmission switch-over mechanism 220 is provided which can selectively transmit and shut off the driving force of the motor 200 to the respective developing units 530. The transmission switch-over mechanism 220 is a known friction gear mechanism, but, briefly described, the transmission switch-over mechanism 220 mainly includes a predetermined gear 221, a maintenance arm 222 which can roll around a rotation axis of the gear 221, and a friction gear 223 which is rotatably maintained in the maintenance arm 222 and is engaged with the gear 221.

As a result, the friction gear 223 can rotate around the gear 221 in a direction depending on the rotation direction of the gear 221. Furthermore, a stepped engagement portion 224 is provided on the maintenance arm 222, and a hook member 226 rolled by a solenoid 225 is suitably engaged with the engagement portion 224.

Moreover, the solenoid 225 or the motor 200 is controlled by the control unit 100, whereby the transmission and the shutoff of the driving force from the motor 200 to the respective developing units 530 is switched over.

Figure 4:
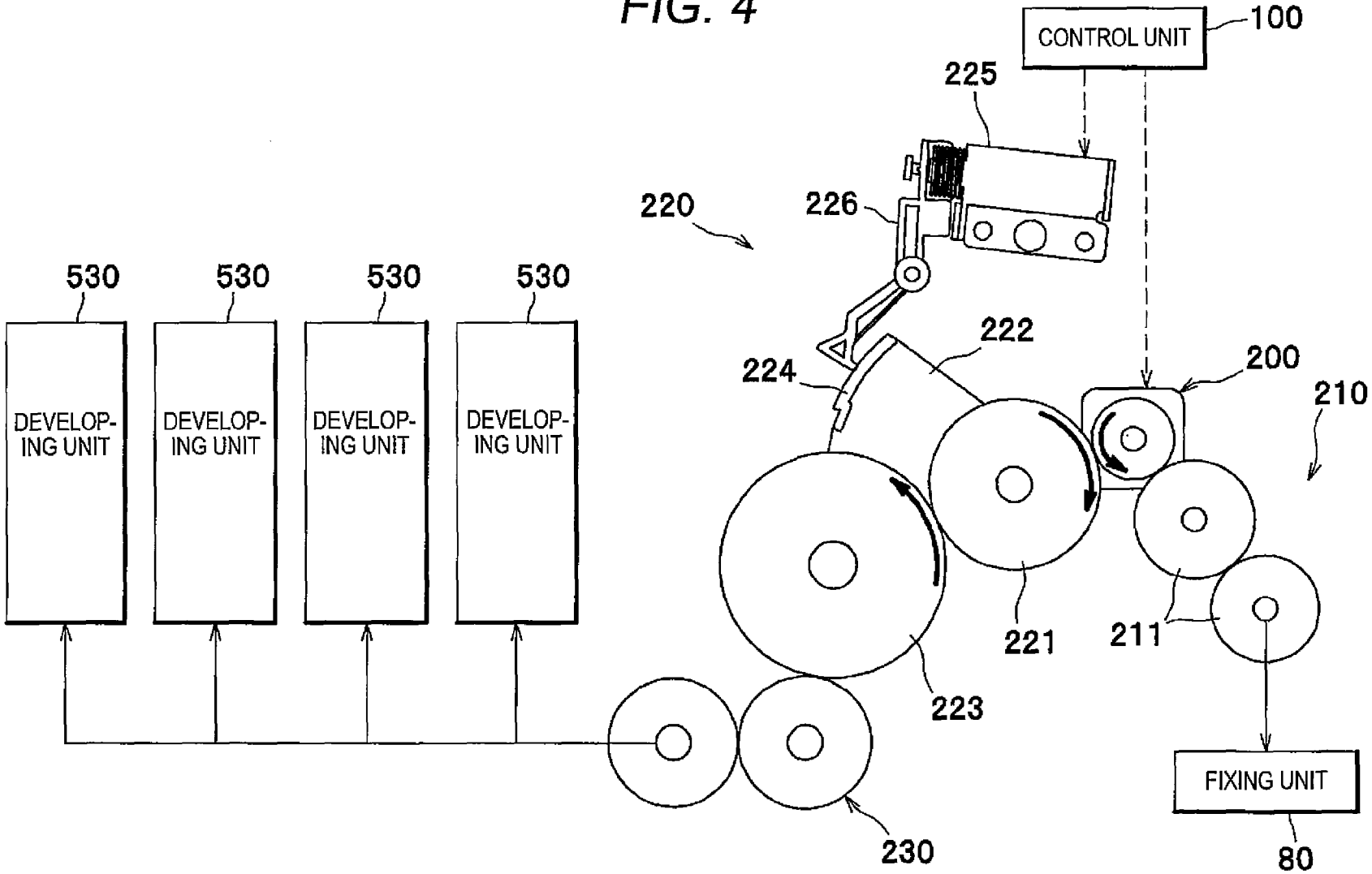
FIG. 4 is an explanatory diagram that shows the state when a transmission switch-over mechanism is connected.

Specifically, when a control unit 100 rotates the motor 200 forward (shown clockwise) from the state of FIG. 3 and controls the solenoid 225 to disengage the hook member 226 from the engagement portion 224, as shown in FIG. 4, the friction gear 223 is engaged near a gear row 230 that is connected to the respective developing units 530. As a result, it is possible to concurrently drive the respective developing units 530 and the fixing unit 80.

Furthermore, when the motor 200 is rotated backward from the state of FIG. 4 by the control unit 100, as shown in FIG. 3, the friction gear 223 is moved so as to be separated from the gear row 230, whereby the connection of the gear row 230 and the motor 200 is disconnected.

In addition, the driving of the drum unit 510, the transport belt 73 or the like is performed by a motor different from the above-mentioned motor 200.

<Control Device>

Hereinafter, the control unit 100 will be described.

The control unit 100 has a CPU, a ROM, a RAM or the like, and is configured so as to perform the reception of a print command (a printing data) according to a prepared program, and the control of the paper feeding portion 20, the image forming apparatus 30, the paper discharging portion 90, the contacting and separating mechanism 110, the motor 200 and the transmission switch-over mechanism 220.

Specifically, as shown in FIG. 2, the control unit 100 is configured so as to carry out a known control of separating the developing roller 53 from the photoreceptor drum 51 depending on the respective modes. Particularly, the control unit 100 brings the respective developing rollers 53 in contact with the respective photoreceptor drums 51 at the time of the color mode, and separates the respective developing rollers 53Y, 53M, and 53C corresponding to the three colors other than black from the respective photoreceptor drums 51Y, 51M and 51C at the time of the monochrome mode.

Furthermore, the control unit 100 separates the respective developing drums 53 from the respective photoreceptor drums 51 at the time of the cleaning mode. Herein, the cleaning mode is a known control, and, briefly described, as shown in FIG. 1, performs a control of transferring the toner withdrawn by the cleaning roller 55 onto the photoreceptor drum 51, thereby withdrawing the toners by the belt cleaner 10 via the photoreceptor drum 51 and the transport belt 73.

Furthermore, the control unit 100 is configured so as to turn OFF the halogen heater HH after the fixing processing in the fixing unit 80 and continues to rotate the motor 200 in this state, thereby carrying out the cooling operation by the rotation of the heating roller 81. Moreover, upon carrying out the cooling operation, the control unit 100 is configured so as to carry out a cut-off control of controlling the transmission switch-over mechanism 220 to disconnect the transmission of the driving force to the respective developing units 530.

When a predetermined condition is included, the control unit 100 carries out only the cooling operation without carrying out the cut-off control during a first time period after the fixing processing, and after the first time period, the control unit 100 restarts the cooling operation after carrying out the cut-off control. Moreover, the control unit 100 is configured so as to carry out the above-mentioned cooling operation and cut-off control together with another control operation performed in the state of prohibiting the printing control.

In addition, as "another control operation performed in the state of prohibiting the printing control", any control may be adopted, but, in the present embodiment, the control operation for carrying out the above-mentioned cleaning mode is adopted. Furthermore, when the number of continuous prints becomes equal to or greater than a predetermined number, the cleaning mode in the present embodiment is carried out at two different timings when the printing control is finished.

Figures 5, 6:
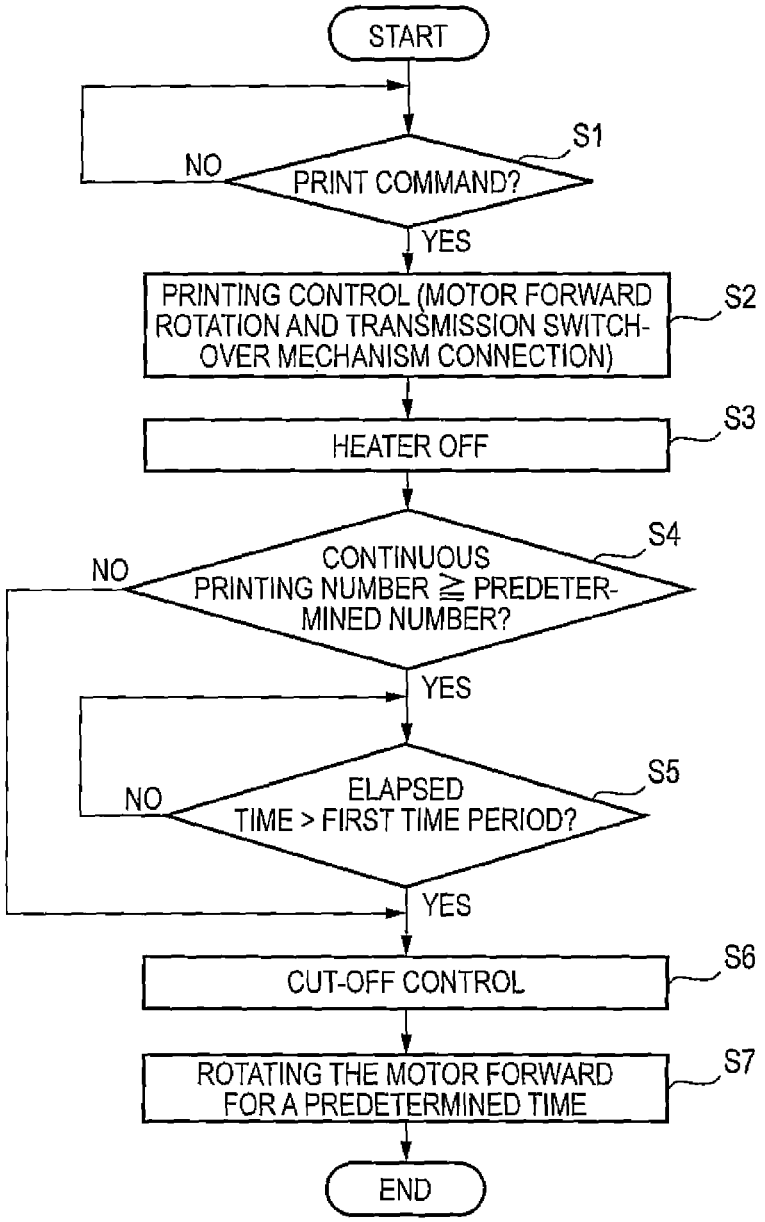
FIG. 5 is a table that shows the relationship between the timing when a cleaning mode is input and the timing when cut-off control is put.
FIG. 6 is a flow chart that shows an operation of a control unit.

Moreover, depending on the respective timing when the cleaning mode is started, the timing starting the above-mentioned cut-off control is changed. That is, as shown in FIG. 5, when the number of continuous prints is equal to or greater than a predetermined number, the control unit 100 waits for the above-mentioned first time period after the printing processing finish (after the fixing processing), and then, performs the cut-off control and the re-driving of the motor 200. Furthermore, after an ordinary printing in which the number of continuous prints does not exceed a predetermined number, the control unit 100 immediately carries out the cut-off control without waiting for the first time period after the printing processing finish, thereby performing the re-driving of the motor 200.

Specifically, the control unit 100 performs the control according to the flow chart shown in FIG. 6. In addition, while the flow chart of FIG. 6 is carried out, the control according to the known flow chart corresponding to the cleaning mode is also concurrently carried out.

As shown in FIG. 6, the control unit 100 firstly decides whether or not the print command exists (S1). When there is a print command (Yes), the known printing control, that is, a control is carried out in which the motor 200 is rotated forward, thereby connecting the transmission switch-over mechanism 220 (S2).

After the printing control is finished, the control unit 100 turns the halogen heater HH OFF (S3), and decides whether or not the number of continuous prints in the printing control is equal to or greater than a predetermined number (S4). When the number of continuous prints is equal to or greater than a predetermined number in step S4 (Yes), the control unit 100 decides whether or not the elapsed time after the printing finish exceeds the first time period (S5), and after waiting for the first time period (Yes), carries out the cut-off control (S6).

Moreover, in step S4, when the number of continuous prints is less than a predetermined number, the control unit 100 immediately carries out the cut-off control without waiting for the first time period (S6). Specifically, in step S6, the control unit 100 firstly stops the motor 200 and reversely rotates the motor 200, thereby stopping the motor 200 by disconnecting the connection by the transmission switch-over mechanism 220.

After step S6, the control unit 100 restarts the cooling operation by rotating the motor 200 forward for a predetermined time (S7), and after a predetermined time has elapsed, finishes the main control.

In addition, in the present embodiment, after disconnecting the connection by the transmission switch-over mechanism 220 in step S6, the motor 200 is stopped and the stopped motor 200 is rotated forward in step S7, but, the invention is not limited thereto. For example, after disconnecting the connection by the transmission switch-over mechanism 220 in step S6, by continuously rotating the motor 200 backward in this state, the cooling operation may be carried out.

Next, a change in temperature in the fixing unit 80 by the control of the above-mentioned control will be described with reference to FIG. 7.

Figure 7A:
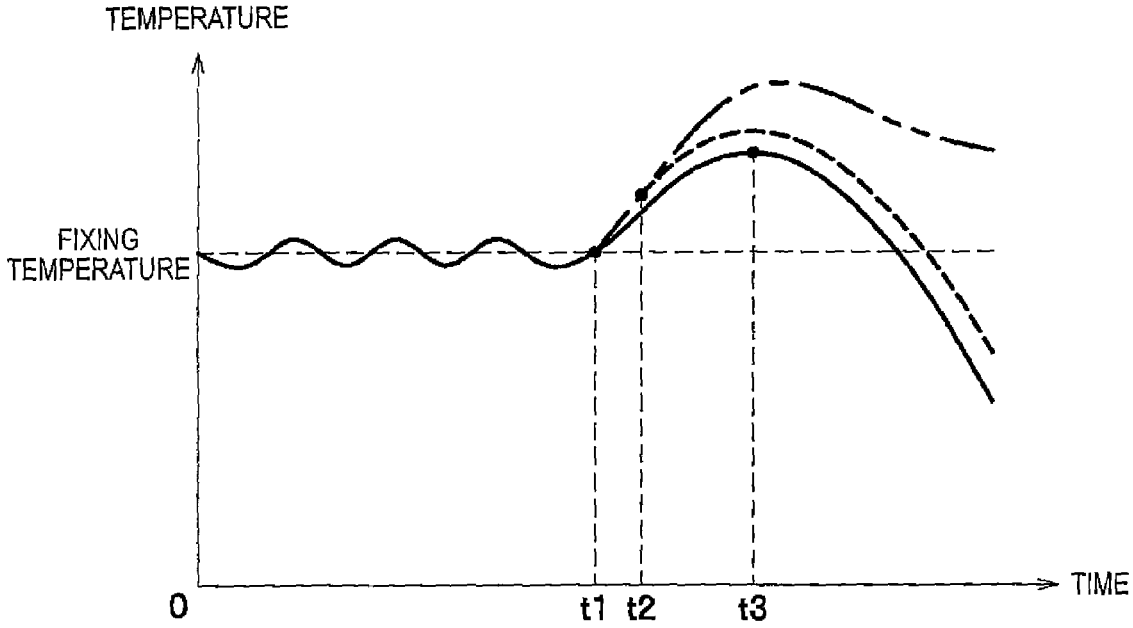
FIG. 7A is a graph showing the temperature change of a fixing unit.
Figure 7B:
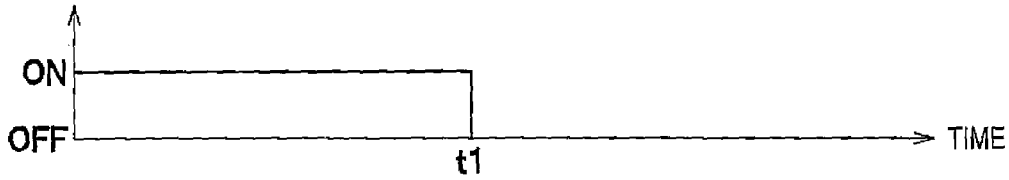
FIG. 7B is a timing chart showing a motor control when a cooling operation is not carried out.

Herein, the temperature change shown by a chain double-dashed line in FIG. 7A is a temperature change of a case of not carrying out the cooling operation (not the case of the invention), and the control of the motor of this time is shown in the timing chart of FIG. 7B. That is, in the case of not carrying out the cooling operation, since the motor is immediately turned OFF at the time t1 after the fixing processing, the temperature in the fixing unit increases relatively rapidly.

Figure 7C:
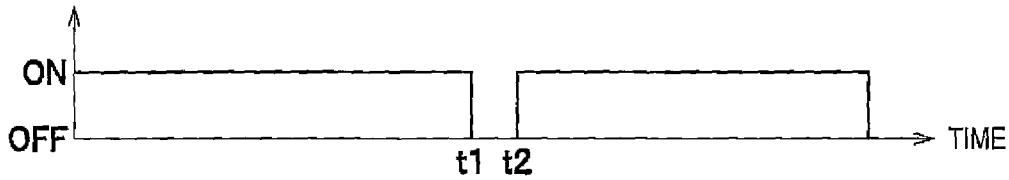
FIG. 7C is a timing chart showing a motor control when a cut-off control is carried out just after the fixing processing.

On the other hand, as shown in FIG. 7C, in the control of carrying out the cooling operation after immediately performing the cut-off control after the fixing processing (S4; No→S6), after performing the cut-off control (after a time t2), the heating roller 81 is rotated by the driving of the motor 200, whereby the inner portion of the fixing unit 80 is cooled (see dotted line of FIG. 7A). For that reason, after the time t2, the temperature increases in a gentle gradient, whereby the temperature is prevented from rising too high.

Figure 7D:
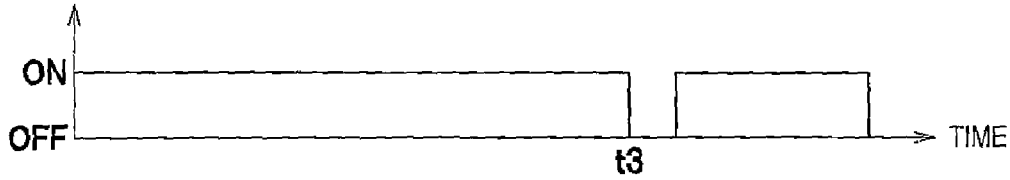
FIG. 7D is a timing chart showing "a motor control" when a cut-off control is carried out by waiting for a first time period after the fixing processing.

Furthermore, as shown in FIG. 7D, in the control of carrying out the cut-off operation after waiting for the first time period after the fixing processing (S4; Yes→S5; Yes→S6), the cooling due to the rotation of the heating roller 81 is immediately started after the fixing processing, and the cooling is continued during the first time period (during times t1 to t3) (see solid line of FIG. 7A). As a result, since the temperature increases in a gentle gradient from the time t1 earlier than the time of the control in which the first time period is not waited for, the temperature is prevented from rising too high.

According to the above, it is possible to obtain the following effects in the present embodiment.

When carrying out the cooling operation, the control unit 100 controls the transmission switch-over mechanism 220, whereby the transmission of the driving force to the developing unit 530 is disconnected. Thus, it is possible to suppress the deterioration due to the driving of the developing unit 530.

Since the control unit 100 can carry out the cut-off control after waiting for the first time period after the fixing processing, it is possible to effectively cool the fixing unit 80 becoming the highest temperature after the fixing processing.

Since the cooling operation or the cut-off control is performed together with the cleaning mode to be performed in the state in which the printing control is prohibited, it is possible to reduce the frequency in which the color printer 1 cannot be used.

In addition, the invention is not limited to the above-mentioned embodiment but can be used in various forms as described later.

In the above-mentioned embodiment, the cleaning mode is performed at two different timings and the timing of the cut-off control is changed accordingly. However, the invention is not limited thereto, for example, in addition to the two different timings of the above-mentioned embodiment, the cleaning mode may be carried out at the timing when the printing mode is changed to the other mode (for example, from the color to the monochrome). In this case, for example, as shown in FIG. 8, the cut-off control, which is performed concurrently with the cleaning mode to be carried out after the mode switch-over, may be performed without waiting for the first time period after the mode switch-over.

In the above-mentioned embodiment, as the developer retainer and the developer retaining unit, the developing roller 53 and the developing unit 530 were adopted, but the invention is not limited thereto, for example, the photoreceptor drum and the drum unit may be adopted.

In the above-mentioned embodiment, the invention was applied to the color printer 1, but the invention is not limited thereto, the invention may be applied to other image forming apparatus, for example, a copier, a multifunction printer, or the like.

In the above-mentioned embodiment, as an example of the recording sheet, a paper P such as a thick paper, a postcard, or a thin paper was adopted, but the invention is not limited thereto, for example, an OHP sheet may be adopted.

In the above-mentioned embodiment, as the heating member, the heating roller 81 heated by the halogen heater HH was adopted, but the invention is not limited thereto, for example, one may be adopted in which the heating roller itself is heated by the means of an IH (Induction Heating) method or the like. Furthermore, the transmission unit, the motor, or the like also are not limited to the above-mentioned embodiment, but can use various types.

In the above-mentioned embodiment, the mechanism using the friction gear 223 as the transmission switch-over mechanism was adopted, but the invention is not limited thereto, for example, a one-way clutch, which transmits the driving force in only one direction, may be adopted. Furthermore, in the above-mentioned embodiment, the transmission switch-over mechanism is disposed adjacent to the motor, but the invention is not limited thereto, if the transmission switch-over mechanism is built in a part of the transmission mechanism from the motor to the developer retaining unit, the same may be disposed in any position.

In the above-mentioned embodiment, the control of waiting for the first time period after the fixing processing and performing the cut-off control, and the control without waiting were selectively carried out depending on the condition, but the invention is not limited thereto, and only any one of two controls may be carried out.

In the above-mentioned embodiment, as "another control operation performed in the state of prohibiting the printing control", the cleaning mode was adopted, but the invention is not limited thereto, for example, the toner is directly printed on the transport belt, and a patch test for investigating whether or not the printed toner is printed on a correct position may be adopted.

What is claimed is:

1. An image forming apparatus comprising:

a developer retaining unit configured to carry a developer;

a fixing unit including a rotatable heating member configured to heat a recording sheet to thermally fix the developer on the recording sheet;

a motor configured to drive the developer retaining unit and the fixing unit;

a transmission unit configured to transmit a driving force of the motor to the fixing unit;

a switching mechanism configured to selectively transmit the driving force of the motor to the developer retaining unit, and shut off the driving force of the motor to the developer retaining unit; and a control unit configured to, in a cooling operation, control the switching mechanism to shut off the driving force of the motor to the developer retaining unit and control the motor to rotate the heating member while the heating member does not heat.

2. The image forming apparatus according to claim 1, wherein, in the cooling operation, the control unit is configured to:

control the switching mechanism to transmit the driving force of the motor to the developer retaining unit, control the motor to rotate the heating member while the heating member does not heat during a first period after the fixing unit heats the recording sheet, control the switching mechanism to shut off the driving force of the motor to the developer retaining unit, and control the motor to rotate the heating member while the heating member does not heat after a second period after the first period.

3. The image forming apparatus according to claim 1, wherein, when the control unit carries out the cooling operation while the control unit controls the switching mechanism to shut off the driving force of the motor to the developer retaining unit, the control unit is configured to concurrently carry out another control operation in a state in which a printing control is prohibited.

4. The image forming apparatus according to claim 1, wherein the developer retaining unit includes a first gear configured to receive the driving force of the motor through the switching mechanism, and the switching mechanism includes a second gear configured to rotate according to the rotation of the motor and selectively contact and separate from the first gear.

5. The image forming apparatus according to claim 4, wherein if the control unit performs printing control, the control unit controls the motor to rotate in a first direction, if the control performs the cooling operation while the second gear is separated from the first gear, the control unit controls the motor to rotate in a second direction opposite to the first direction to separate the second gear from the first gear.

6. The image forming apparatus according to claim 5, wherein the switching mechanism includes a holding unit configured to hold the second gear in a state that the second gear is separated from the first gear.

7. The image forming apparatus according to claim 1, wherein the roller of the fixing device is a heating roller, and the heater is configured to heat the heating roller.

8. An image forming apparatus comprising:

a developing roller;

a fixing unit comprising a roller and a heater;

a motor for driving the developing roller and the roller of the fixing unit;

a transmission unit configured to transmit driving force of the motor to the roller of the fixing unit;

a switching mechanism configured to:

transmit the driving force of the motor to the developing roller in printing processing, and shut off the driving force of the motor to the developing roller in cooling operation, after the printing processing; and a control unit configured to:

control, in the cooling operation, the switching mechanism to shut off the driving force of the motor to the developing roller, control, in the cooling operation, the heater not to generate heat, and control, in the cooling operation, the motor to drive the roller of the fixing unit.

9. The image forming apparatus according to claim 1, further comprising:

a gear, wherein the developing roller receive the driving force of the motor thorough the gear.

10. The image forming apparatus according to claim 8, wherein the control unit is configured to control, throughout an entirety of the cooling operation, the heater to not generate heat.

11. The image forming apparatus according to claim 8, wherein the control unit is configured to control, throughout an entirety of the cooling operation, the motor to continue to drive the roller of the fixing unit.

12. An image forming apparatus comprising:

a developing roller;

a fixing unit comprising a roller and a heater;

a motor for driving the developing roller and the roller of the fixing unit;

a transmission unit configured to transmit a driving force of the motor to the roller of the fixing unit;

a switching mechanism configured to:

transmit the driving force of the motor to the developing roller in printing processing, and shut off the driving force of the motor to the developing roller in a cooling operation, after the printing processing; and a control unit configured to:

turn off the heater, in the cooling operation, control, in the cooling operation, the switching mechanism to shut off the driving force of the motor to the developing roller, and control, in the cooling operation, the motor to drive the roller of the fixing unit.

13. The image forming apparatus according to claim 12, further comprising a gear, wherein the developing roller is configured to receive the driving force of the motor thorough the gear.

14. The image forming apparatus according to claim 12, wherein the roller of the fixing device is a heating roller, and the heater is configured to heat the heating roller.

15. The image forming apparatus according to claim 12, wherein the control unit is configured to control, throughout an entirety of the cooling operation, the heater to not generate heat.

16. The image forming apparatus according to claim 12, wherein the control unit is configured to control, through an entirety of the cooling operation, the motor to continue to drive the roller of the fixing unit.

* * * * *